US010134252B1

(12) United States Patent
Patterson et al.

(10) Patent No.: US 10,134,252 B1
(45) Date of Patent: Nov. 20, 2018

(54) DUAL-SIDED SECURITY MARKER

(71) Applicants: Hubert A. Patterson, Boca Raton, FL (US); Thomas Solaski, Boca Raton, FL (US)

(72) Inventors: Hubert A. Patterson, Boca Raton, FL (US); Thomas Solaski, Boca Raton, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 15/600,997

(22) Filed: May 22, 2017

(51) Int. Cl.
*G08B 13/18* (2006.01)
*G08B 13/24* (2006.01)

(52) U.S. Cl.
CPC ..... *G08B 13/2434* (2013.01); *G08B 13/2437* (2013.01)

(58) Field of Classification Search
CPC ..... G08B 13/2402; G08B 13/2448; G08B 13/2437
USPC ..... 340/572.5
See application file for complete search history.

(56) References Cited

U.S. PATENT DOCUMENTS

2004/0207528 A1* 10/2004 Fabian ..... G08B 13/2408 340/572.6
2009/0195386 A1* 8/2009 Peter ..... G08B 13/2408 340/572.1
2014/0218197 A1* 8/2014 Li ..... G08B 13/2437 340/572.6
2015/0356842 A1* 12/2015 Zirk ..... G08B 13/2434 333/239
2016/0351034 A1* 12/2016 Trivelpiece ..... E05B 73/0047

* cited by examiner

*Primary Examiner* — Kevin Kim
(74) *Attorney, Agent, or Firm* — Fox Rothschild LLP; Robert J. Sacco; Carol E. Thorstad-Forsyth

(57) ABSTRACT

Systems and methods for making a marker. The methods comprise: obtaining a marker housing having first and second cavities formed therein; disposing a first resonator in the first cavity and a second resonator in a second cavity; and placing a bias element at a location on or in the marker so that the first and second resonators are (a) equally spaced apart from the same bias element and (b) biased by the same bias element when the marker is in use to oscillate at a frequency of a received transmit burst.

18 Claims, 7 Drawing Sheets

DUAL-SIDED SECURITY MARKER

FIELD

This document relates generally to security markers. More particularly, this document relates to dual-sided security markers.

BACKGROUND

A typical EAS system in a retail setting may comprise a monitoring system and at least one security tag or marker attached to an article to be protected from unauthorized removal. The monitoring system establishes a surveillance zone in which the presence of security tags and/or markers can be detected. The surveillance zone is usually established at an access point for the controlled area (e.g., adjacent to a retail store entrance and/or exit). If an article enters the surveillance zone with an active security tag and/or marker, then an alarm may be triggered to indicate possible unauthorized removal thereof from the controlled area. In contrast, if an article is authorized for removal from the controlled area, then the security tag and/or marker thereof can be deactivated and/or detached therefrom. Consequently, the article can be carried through the surveillance zone without being detected by the monitoring system and/or without triggering the alarm.

The security tag or marker generally consists of a housing. The housing is made of a low cost plastic material, such as polystyrene. The housing is typically manufactured with a drawn cavity in the form of a rectangle. A bias magnet is disposed within the housing adjacent to one or more magnetoelastic resonator. The bias magnet is made of a semi-hard magnetic material. The resonator(s) is(are) made of a soft magnetic material in the form of an elongate thin ribbon produced by rapid quenching. During operation, the security tag or marker produces a resonant signal with a particular amplitude that is detectable by the monitoring system. Notably, markers with a single resonator have about 65% of the amplitude of markers with two resonators. As such, single resonator markers have reduced system performance as compared to dual resonator markers.

There is a desire to reduce the width and/or thickness of the markers, and reduce the amount of resonator and bias materials used. Reducing the resonator width and/or thickness results in proportionally less output and reduced system performance.

SUMMARY

Systems and methods are described herein for making a marker. The methods comprise: obtaining a marker housing having first and second cavities formed therein; disposing a first resonator in the first cavity and a second resonator in a second cavity; and placing a bias element at a location on or in the marker so that the first and second resonators are (a) equally spaced apart from the same bias element and (b) biased by the same bias element when the marker is in use to oscillate at a frequency of a received transmit burst.

In some scenarios, the first and second cavities are horizontally or vertically spaced apart from each other. The first and second cavities are formed in the same housing portion of at least two separate housing portions defining the marker housing, or alternatively formed in different housing portions of at least two separate housing portions defining the marker housing. The first and second cavities have the same or different shapes or sizes. The different shapes and/or sizes are selected in accordance with the first and second resonators' geometries.

In those or other scenarios, the first and second resonators respectively reside on two opposing sides or ends of the bias element. For example, the bias element is sandwiched between the first and second resonators. The detectable beat frequency is generated between the resonators in response to a received transmit burst.

DESCRIPTION OF THE DRAWINGS

The present solution will be described with reference to the following drawing figures, in which like numerals represent like items throughout the figure.

DETAILED DESCRIPTION

Figure 1:
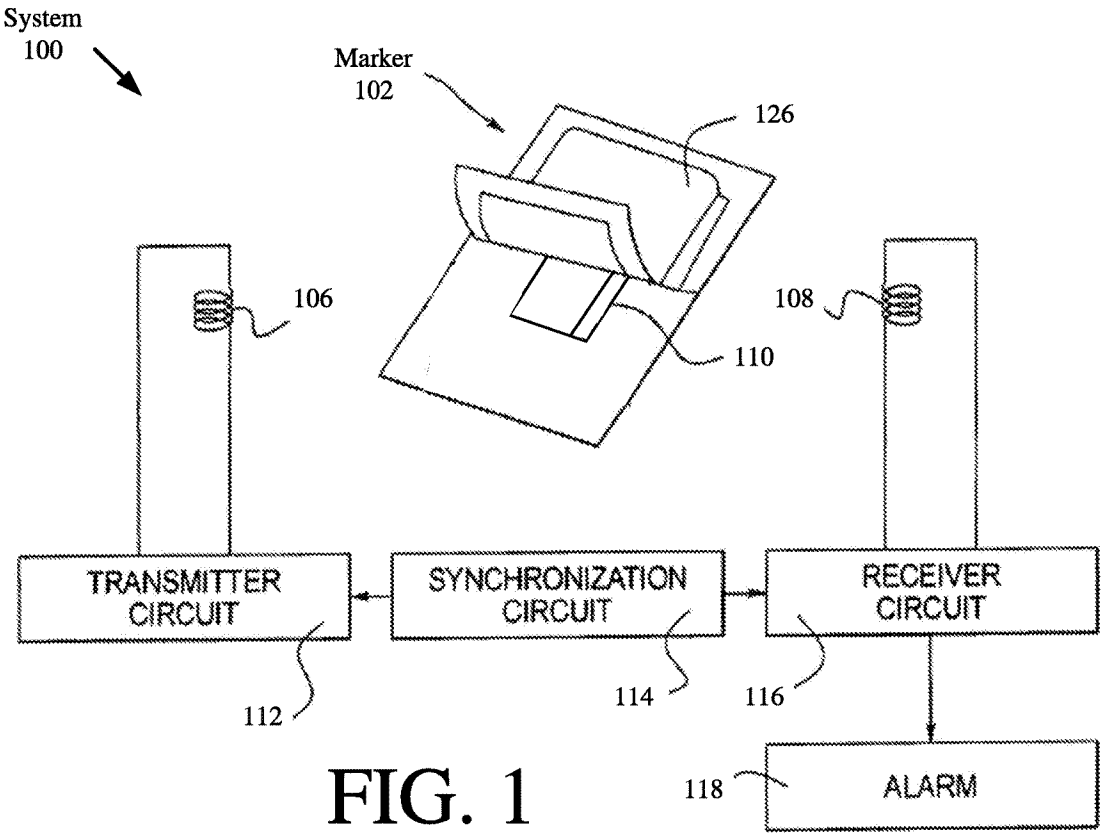
FIG. 1 is an illustration of an illustrative system comprising a marker.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Currently, dual resonator markers comprise two resonators residing in a single cavity of the housing. Because the resonators sit literally on top of each other, the addition of two resonators does not result in a doubling of amplitude. The resulting increase is about 1.6 times the single resonator's output amplitude. In addition, the two resonators being closely coupled pull the frequency of the individual resonators toward a single common frequency.

The present solution concerns a marker having two resonators placed in separate cavities. Since the two resonators reside in separate cavities, the coupling between the resonators is greatly reduced. As a result, the individual resonator frequencies are not pulled together as much as is the case when both resonators are in the same cavity. Also, the two resonators do not load each other as much as when both are in the same cavity, so the amplitude from two resonators is close to two times the output from a single resonator. By being on each side or end of the bias strip, each resonator is advantageously biased by the same bias strip. The resulting label is slightly thicker than a single cavity resonator. However, each cavity is thinner than the existing cavity housing two resonators since it only contains a single resonator in the present solution. The thinner cavities are less likely to be crushed under stress of application or bending. As such, the present solution provides markers with improved performance both under crush conditions and bending conditions.

Since the amplitude is not reduced as severely as when both resonators are in a single cavity, the amount of resonator material can be reduced compared to a single cavity label and still maintain the same output amplitude. In theory, the resonator's and bias magnet's width can go from 6 mm to 5 mm and still maintain equal output. The result is a thicker but narrower label with equivalent system performance.

In addition, since the resonators are more loosely coupled, it is possible to detect the beat frequency between the two resonators. While beat frequency is not used today, added system performance may be facilitated by the new construction as explained further below.

Illustrative EAS System

Referring now to FIG. 1, there is provided a schematic illustration of an illustrative EAS system 100. The EAS system 100 comprises a monitoring system 106-112, 114-118 and at least one marker 102. The marker 102 may be attached to an article to be protected from unauthorized removal from a business facility (e.g., a retail store). The monitoring system comprises a transmitter circuit 112, a synchronization circuit 114, a receiver circuit 116 and an alarm 118.

During operation, the monitoring system 106-112, 114-118 establishes a surveillance zone in which the presence of the marker 102 can be detected. The surveillance zone is usually established at an access point for the controlled area (e.g., adjacent to a retail store entrance and/or exit). If an article enters the surveillance zone with an active marker 102, then an alarm may be triggered to indicate possible unauthorized removal thereof from the controlled area. In contrast, if an article is authorized for removal from the controlled area, then the marker 102 can be deactivated and/or detached therefrom. Consequently, the article can be carried through the surveillance zone without being detected by the monitoring system and/or without triggering the alarm 118.

The operations of the monitoring system will now be described in more detail. The transmitter circuit 112 is coupled to the antenna 106. The antenna 106 emits transmit (e.g., "Radio Frequency ("RF")) bursts at a predetermined frequency (e.g., 58 KHz) and a repetition rate (e.g., 50 Hz, 60 Hz, 75 Hz or 90 Hz), with a pause between successive bursts. In some scenarios, each transmit burst has a duration of about 1.6 ms. The transmitter circuit 112 is controlled to emit the aforementioned transmit bursts by the synchronization circuit 114, which also controls the receiver circuit 116. The receiver circuit 116 is coupled to the antenna 108. The antenna 106, 108 comprises close-coupled pick up coils of N turns (e.g., 100 turns), where N is any number.

When the marker 102 resides between the antennas 106, 108, the transmit bursts transmitted from the transmitter 112, 108 cause a signal to be generated by the marker 102. In this regard, the marker 102 comprises a stack 110 (two resonators and a bias element) disposed in a marker housing 126. The transmit bursts emitted from the transmitter 112, 108 drive the resonators to oscillate at a resonant frequency (e.g., 58 KHz). As a result, a signal is produced with an amplitude that decays exponentially over time.

The synchronization circuit 114 controls activation and deactivation of the receiver circuit 116. When the receiver circuit 116 is activated, it detects signals at the predetermined frequency (e.g., 58 KHz) within first and second detection windows. In the case that a transmit burst has a duration of about 1.6 ms, the first detection window will have a duration of about 1.7 ms which begins at approximately 0.4 ms after the end of the transmit burst. During the first detection window, the receiver circuit 116 integrates any signal at the predetermined frequency which is present. In order to produce an integration result in the first detection window which can be readily compared with the integrated signal from the second detection window, the signal emitted by the marker 102 should have a relatively high amplitude (e.g., greater than or equal to about 1.5 nanowebers (nWb)).

After signal detection in the first detection window, the synchronization circuit 114 deactivates the receiver circuit 116, and then re-activates the receiver circuit 116 during the second detection window which begins at approximately 6 ms after the end of the aforementioned transmit burst. During the second detection window, the receiver circuit 116 again looks for a signal having a suitable amplitude at the predetermined frequency (e.g., 58 kHz). Since it is known that a signal emanating from the marker 102 will have a decaying amplitude, the receiver circuit 116 compares the amplitude of any signal detected at the predetermined frequency during the second detection window with the amplitude of the signal detected during the first detection window. If the amplitude differential is consistent with that of an exponentially decaying signal, it is assumed that the signal did, in fact, emanate from a marker between antennas 106, 108. In this case, the receiver circuit 116 issues an alarm 118.

Illustrative Marker Architectures

The marker 102 of FIG. 1 can have many different structures depending on a given application. Illustrative marker architectures will be described below. Marker 102 can have the same or substantially similar architecture as any one of the markers discussed herein.

Figure 2:
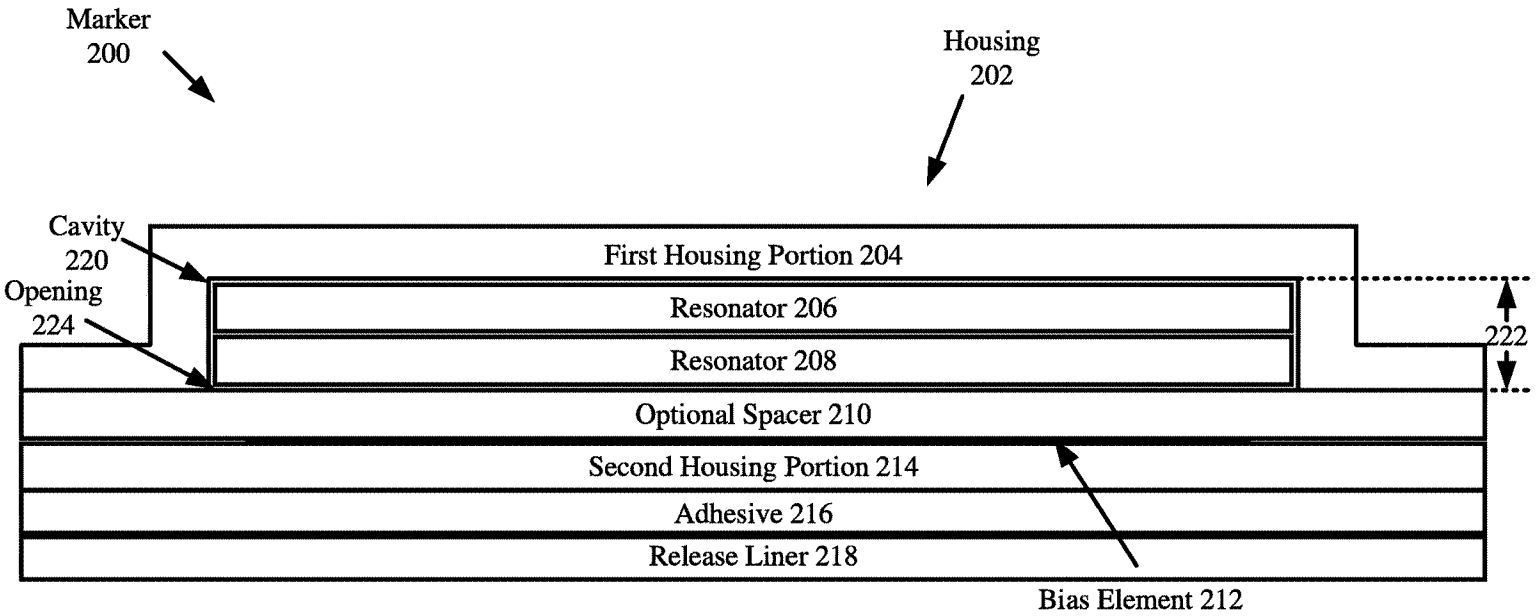
FIG. 2 (Prior Art)
FIG. 2 is an illustration of an illustrative conventional marker.

Referring now to FIG. 2, there is provided an illustration of an illustrative conventional marker 200. The conventional marker 200 comprises a housing 202 formed of a first housing portion 204 and a second housing portion 214. The housing 202 can include, but is not limited to, a high impact polystyrene. An adhesive 216 and release liner 218 are disposed on the bottom surface of the second housing portion 214 so that the marker 200 can be attached to an article (e.g., a piece of merchandise or product packaging).

A cavity 220 is formed in the first housing portion 204. Resonators 206, 208 are disposed in the cavity 220 in a stacked configuration. In this regard, the two resonators 206, 208 are arranged so as to reside adjacent to one another as shown in FIG. 2 (i.e., one on top of the other). The resonators 206, 208 are shown as comprising generally rectangular shapes with the same dimensions (e.g., width, length and/or height) and planar cross-sectional profiles. In some scenarios, the resonators 206, 208 alternatively have arched or concave cross-sectional profiles. A spacer 210 is optionally disposed so as to seal an opening 224 of the cavity 220 whereby the resonators 206, 208 are securely disposed and retained in the cavity 220. The spacer 210 can include, but is not limited to, a low density polyethylene.

A bias element 212 is disposed between the spacer 210 and the second housing portion 214. The bias element 212 includes, but is not limited to, an iron-based semi-hard magnet. The spacer 210 is optionally provided so that the physical spacing of and between the bias element 212 and the resonator 208 can be maintained.

Notably, the conventional marker 200 suffers from certain drawbacks. For example, conventional marker 200 does not have a doubled amplitude as a result of the inclusion of two resonators 206, 208 in the single cavity 220. Instead, the resulting increase in amplitude is only about 1.6 times that of a marker with a single resonator. Additionally, the frequencies of the two resonators 206, 208 are pulled toward a single common frequency.

The present solution overcomes these drawbacks of the conventional marker 200. The manner in which the drawbacks of the conventional marker 200 are overcome by the present solution will be become evident as the discussion progresses.

Figure 3:
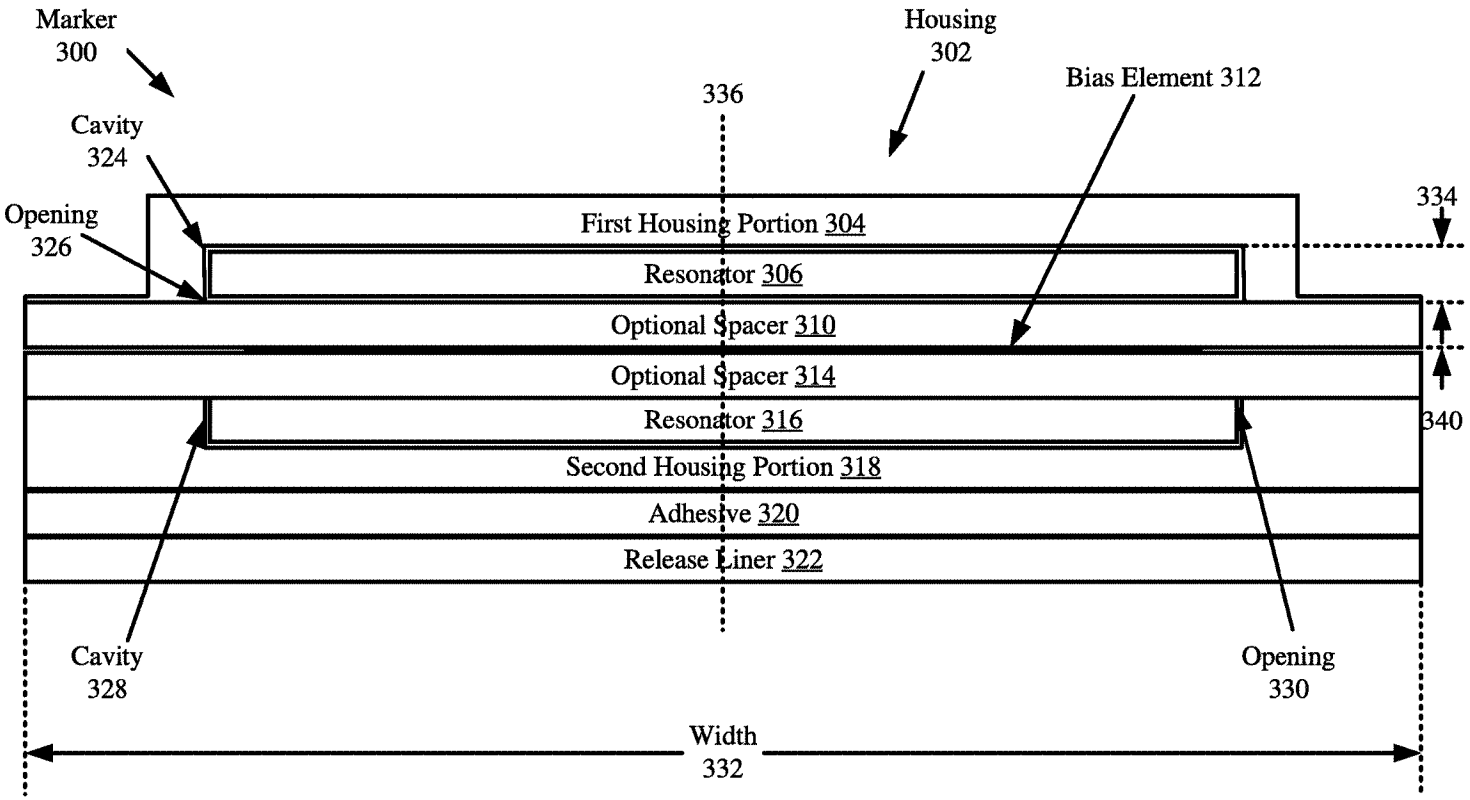
FIG. 3 is an illustration of an illustrative marker designed in accordance with the present solution.

Referring now to FIG. 3, there is provided a more detailed illustration of a marker 300 designed in accordance with the present solution. Marker 300 has an increased amplitude as compared to that of conventional marker 200 shown in FIG. 2. The increased amplitude of marker 300 at least partially results from (a) the materials used to form the resonators 306, 316 and bias element 312, (b) the use of optional spacers 310, 314, and/or (c) the placement of the two resonators 306, 316 in separate cavities 324, 328 formed in the housing 302.

The resonators 306, 316 can be formed of any suitable resonator material. An illustrative suitable resonator material is made from Fe, Co and Ni as main elements. Thus, the resonator material can have a chemical composition of $Fe_aCoBNi_cSi_dB_e$, wherein a, b, c, d and e are in atomic percent. The values of a-e can respectively fall within the following ranges: $22 \le a \le 36$; $10 \le b \le 13$; $43 \le c \le 49$; $1 \le d \le 4$; and $15 \le e \le 17$. For example, the resonator material may have a chemical composition $Fe_{24}Co_{12}Ni_{46}Si_2B_{16}$. The atomic percentages for Fe, Co and Ni may vary approximately ±5% from the stated values for atomic percent.

The resonator material may be rapidly quenched and annealed prior to assembly of the marker 300. The manner in which the resonator material is quenched can be the same as or similar to that disclosed in U.S. Pat. No. 4,142,571 ("the '571 patent") and U.S. Pat. No. 7,088,246 ("the '246 patent), the disclosures of which are incorporated herein by reference. The manner in which the resonator material is annealed can be the same as or similar to that disclosed in U.S. Pat. No. 6,645,314 ("the '314 patent"), the disclosure of which is incorporated herein by reference.

The resonators are shown in FIG. 3 as having generally rectangular shapes with planar cross-sectional profiles. The present solution is not limited in this regard. The resonators can have any shape selected in accordance with a given application. For example, the resonators 306, 316 alternatively have arched or concave cross-sectional profiles. Also, the resonators 306, 316 can have the same geometric dimensions or different geometric dimensions (e.g., width 332, length and/or thickness 334). Resonators with different geometric dimensions allow for additional signal complexity. For a given bias field, the resonant frequency of the resonator is directly proportional to the length. By selecting resonators of different lengths, two different resonant frequencies are generated which, when combined, can create a beat frequency. So, in the present solution, there are two or three frequencies compared to the single frequency of the conventional solutions.

The bias element 312 is formed of any suitable resonator material. An illustrative suitable resonator material is a semi-hard magnetic material, such as the material designated as "SensorVac", which is available from Vacuumschmelze, Hanau, Germany. The bias element 312 is in a ribbon-shaped length of the semi-hard magnetic material. In some scenarios, the bias element 312 has a width of equal to or less than 6 mm and a thickness of equal to or less than 48 microns.

In order to place the bias element 312 in an activated condition, the bias element is magnetized substantially to saturation with the polarity of magnetization parallel to the length of the bias element. To deactivate the marker, the magnetic state of the bias element is substantially changed by degaussing the bias element via the application of an AC magnetic field. When the bias element 312 is degaussed, it no longer provides the bias field required to cause the resonators 306, 316 to oscillate at the operating frequency of the EAS system. The marker may also be deactivated by imparting an alternating series of magnetic poles (i.e., NS N S N S N) along the length of the bias element. This breaks up the bias field on the resonators and substantially deactivates the label.

The resonators 306, 316 are stacked vertically along axis 336 so as to be disposed on opposing sides of the bias element 312 (i.e., a top side and a bottom side). In effect, the resonators 306, 316 are equally spaced apart from and/or biased by the same bias element 312. The resonators 306, 316 may be spaced apart from the bias element 312 via optional spacers 310, 314. Each spacer 310, 314 is formed of any suitable material, such as plastic. The thickness of the spacer 310, 314 is selected to in accordance with a particular application. In some scenarios, each spacer 310, 314 has a thickness greater than or equal to 10 mils. The spacing 340 between the resonators 306, 316 and bias element 312 is selected to optimize the bias field applied to the resonators while minimizing the magnetic damping effect caused by the attraction of the resonator to the bias element. Magnetic clamping/damping results in a shift in resonant frequency and a loss of amplitude, therefore it needs to be minimized. For example, increasing the spacing 340 reduces the effective bias field while also reducing the magnetic clamping. However, this increases the overall height and/or thickness of the marker. So the spacing 340 helps tune the marker 300 to the proper frequency while optimizing the efficiency of the system (i.e., amplitude). The spacers are optionally included in marker 300 at least partially based on the desired distance 340 between the resonators 306, 316.

As noted above, the resonators 306, 316 are placed in separate cavities formed in the housing 302. In this regard, the housing 302 comprises a first housing portion 304 and a second housing portion 318. Each housing portion 304, 318 has a cavity 324, 328 formed therein. The resonators 306, 316 are respectively disposed is the two separate cavities 324, 328. Accordingly, the cavities are sized and shaped to respectively receive the resonators 306, 316. The size and shape of each cavity is selected in accordance with the respective resonator's geometry. In some cases, the cavities have the same shape and/or size, while in other scenarios the cavities have different shapes and/or sizes. Accordingly, the cavities 324, 328 can have the same or different geometric properties.

As a result of the resonators' placement in two separate cavities, the coupling between the resonators 306, 316 is reduced as compared to that of the conventional markers 200 having two resonators 206, 208 disposed in a single cavity 220. Additionally, the frequencies of the resonators 306, 316 are not pulled together as much as is the case when both resonators are in the same cavity (as shown in FIG. 2). Also, the two resonators 306, 316 do not load each other as much as when both are in the same cavity (as shown in FIG. 2), so the amplitude from the two resonators 306, 316 is approximately two times the output from a marker comprising only one resonator.

Since the resonators 306, 316 are more loosely coupled, a signal having a beat frequency may be generated by the marker 300 in response to a transmit burst transmitted from a transmitter (e.g., transmitter 112, 108 of FIG. 1). The beat frequency is generated when the two resonators have different lengths. The beat frequency is defined by the difference between the resonant frequencies of the two resonators. For example, a first resonator has a resonant frequency of 57.6 kHz and a second resonator has a resonate frequency of 58.4 kHz. In this case, the beat frequency is 0.8 kHz. Notably, the conventional marker 200 does not generate a detectable signal with this beat frequency in response to the transmit bursts. The beat frequency is different from the two frequencies typically generated by the resonators. As such, the beat frequency provides a way to prevent false alarms and/or signal interference. In this regard, it should be understood that the transmitter 112, 108 of FIG. 1 transmits transmit bursts at a resonant frequency of the resonators (i.e., 58 kHz). The transmit burst at 58 kHz (and possibly other frequencies) is close to the resonant frequency of the resonators. The resonators couple with the transmit field at this forced frequency but with less efficiency than if the transmit was at the exact resonant frequency of the resonators. However, the resonators respond at their own resonant frequencies when the transmit burst is turned off. When allowed to vibrate freely at these different resonant frequencies, the resonators create the beat frequency. This is why the transmitters are turned "on" and "off" so that signal interference is minimized between interrogation signals and marker response signals. If the response is sent at the beat frequency, then the marker response signals experiences less noise as compared to response signals sent at the same frequency as the transmit bursts. Also, the beat frequency allows the transmission of a continuous transmit burst (i.e., the transmitters are not turned "on" and "off"). In effect, the beat frequency provides an improved system as compared to conventional systems.

The housing 302 can include, but is not limited to, a high impact polystyrene. An adhesive 320 and release liner 322 are disposed on the bottom surface of the housing 302 so that the marker 300 can be attached to an article (e.g., a piece of merchandise).

Figure 4:
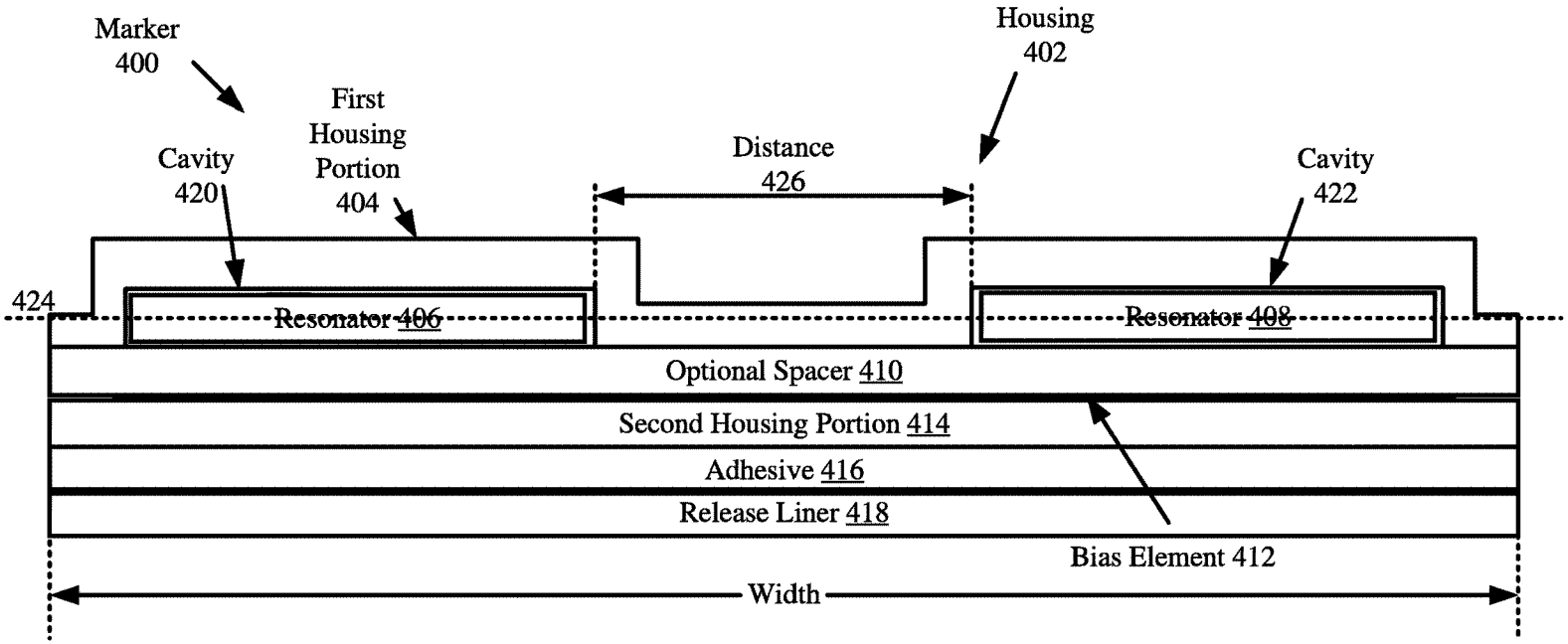
FIG. 4 is an illustration of another illustrative marker designed in accordance with the present solution.

Referring now to FIG. 4, there is provided an illustration of another illustrative marker 400 in accordance with the present solution. Marker 400 has an increased amplitude as compared to that of conventional marker 200 shown in FIG. 2. The increased amplitude of marker 400 at least partially results from (a) the materials used to form the resonators 406, 408 and bias element 412, (b) the use of optional spacer 410, and/or (c) the placement of the two resonators 406, 408 in separate cavities 420, 422 formed in the housing 402.

The resonators 406, 408 can be formed of any suitable resonator material. This material can be the same as or similar to that used to form resonators 306, 316 of FIG. 3. The resonator material may be rapidly quenched and annealed prior to assembly of the marker 400.

The resonators are shown in FIG. 4 as having generally rectangular shapes with planar cross-sectional profiles. The present solution is not limited in this regard. The resonators can have any shape selected in accordance with a given application. For example, the resonators 406, 408 alternatively have arched or concave cross-sectional profiles. Also, the resonators 406, 408 can have the same geometric dimensions or different geometric dimensions (e.g., width, length and/or thickness). Resonators with different geometric dimensions allow for additional signal complexity.

The bias element 412 is formed of any suitable resonator material. An illustrative suitable resonator material is a semi-hard magnetic material, such as the material designated as "SensorVac", which is available from Vacuumschmelze, Hanau, Germany. The bias element 412 is in a ribbon-shaped length of the semi-hard magnetic material. The bias element 412 has a width of equal to or greater than 6 mm and a thickness of equal to or less than 48 microns. The width is approximately equal to the cumulative widths of the resonators plus the distance 426. The width depends on the thickness, flux, resonator coupling, and/or spacing. The bias element 412 has geometric dimensions selected so that a portion thereof is vertically aligned with and vertically offset from a portion of each resonator 406, 408 (i.e., the bias element's portion resides below or above the resonator's portion by a given distance).

In order to place the bias element 412 in an activated condition, the bias element is magnetized substantially to saturation with the polarity of magnetization parallel to the length of the bias element. To deactivate the marker, the magnetic state of the bias element is substantially changed by degaussing the bias element via the application of an AC magnetic field. When the bias element 412 is degaussed, it no longer provides the bias field required to cause the resonators 406, 408 to oscillate at the operating frequency of the EAS system.

The resonators 406, 408 are horizontally disposed along axis 424 so as to reside on opposing sides or ends of the marker 400 (e.g., a left side/end and a right side/end) and have a generally parallel arrangement. The resonators 406, 408 are also disposed above the bias element 412 by the same distance. In effect, the resonators 406, 408 are equally spaced apart from and/or biased by the same bias element 412. The resonators 406, 408 may be spaced apart from the bias element 412 via optional spacer 410. Spacer 410 can be the same as or similar to spacers 310, 314 of FIG. 3. Notably, the bias element provides a shield between the two resonators that helps keep them from interfering (pulling) each other. The added spacer provides a relatively thin surface (e.g., plastic surface) for the resonators to sit on so they do not directly sit on the bias element. Intimate contact between the resonators and bias element produces excessive clamping. In some scenarios, the spacer 410 has a thickness of 4-8 mils.

As noted above, the resonators 406, 408 are placed in separate cavities formed in the housing 402. In this regard, the housing 402 comprises a first housing portion 404 with two cavities 420, 422 formed therein. The cavities 420, 422 are horizontally spaced apart by a distance 426. Distance 426 is selected so that destructive coupling between the two resonators can be minimized (i.e., increase amplitude efficiency) while retaining as small a footprint as possible.

The resonators 406, 408 are respectively disposed is the two separate cavities 420, 422. As a result, the coupling between the resonators 406, 408 is reduced as compared to that of the conventional markers 200 having two resonators 206, 208. Additionally, the frequencies of the resonators 406, 408 are not pulled together as much as is the case when both resonators are in the same cavity (as shown in FIG. 2). Also, the two resonators 406, 408 do not load each other as much as when both are in the same cavity (as shown in FIG. 2), so the amplitude from the two resonators 406, 408 is approximately two times the output from a marker comprising only one resonator.

Since the resonators 406, 408 are more loosely coupled, a signal having a beat frequency is generated by the marker 400 in response to a transmit burst transmitted from a transmitter (e.g., transmitter 112, 108 of FIG. 1). The advantages of this beat frequency are discussed above in relation to FIG. 3.

The housing 402 can include, but is not limited to, a high impact polystyrene. An adhesive 416 and release liner 418 are disposed on the bottom surface of the housing 402 so that the marker 400 can be attached to an article (e.g., a piece of merchandise or product packaging).

Figure 5:
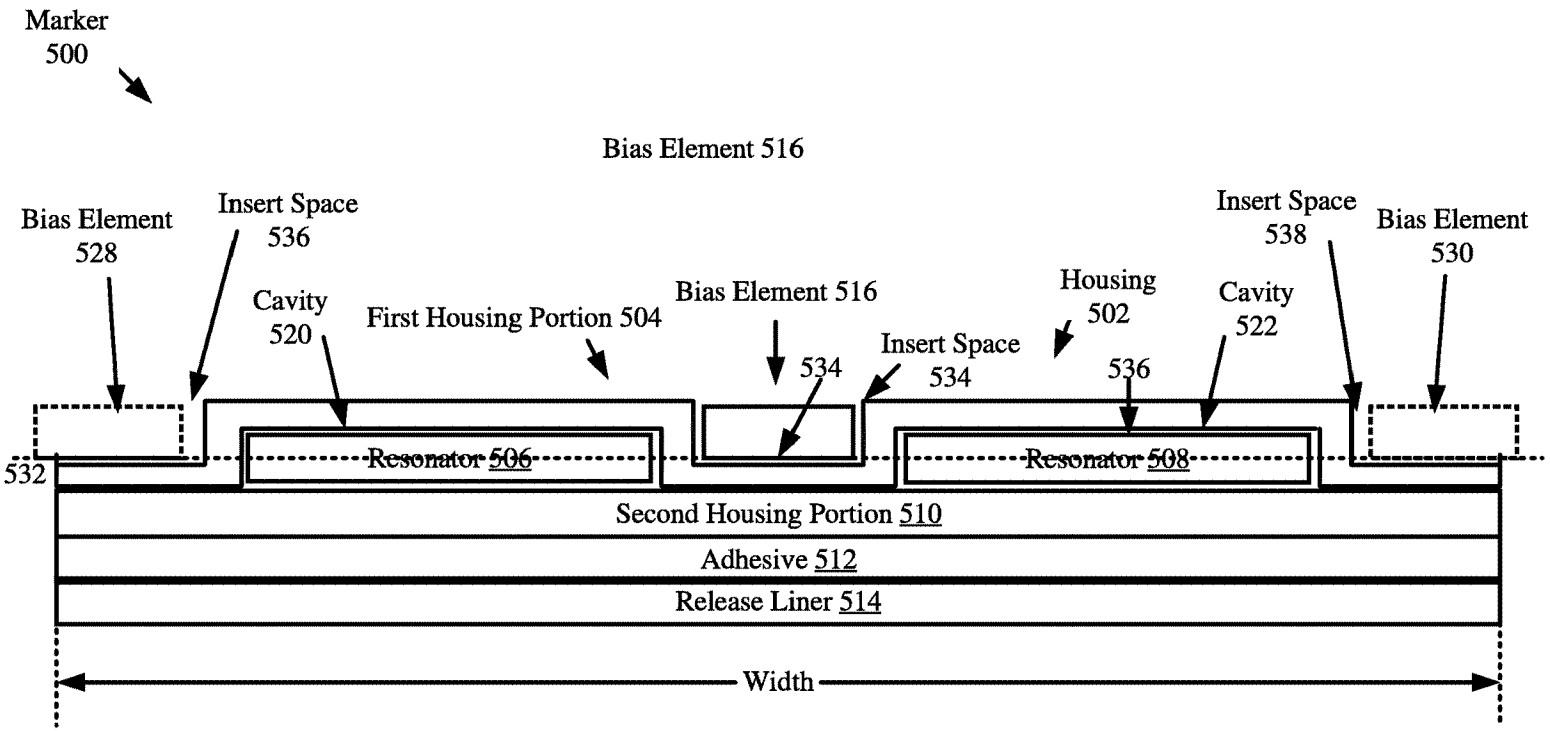
FIG. 5 is an illustration of another illustrative marker designed in accordance with the present solution.

Referring now to FIG. 5, there is provided an illustration of an illustrative marker 500 designed in accordance with the present solution. Marker 500 has an increased amplitude as compared to that of conventional marker 200 shown in FIG. 2. The increased amplitude of marker 500 at least partially results from (a) the materials used to form the resonators 506, 508 and bias element(s) 516, 528, 530 and/or (b) the placement of the two resonators 506, 508 in separate cavities 520, 522 formed in the housing 502. Notably, the marker 500 architecture of FIG. 5 is similar to that of FIG. 4 except for the placement of the bias element(s) and the elimination of the optional spacer(s).

The resonators 506, 508 can be formed of any suitable resonator material. This material can be the same as or similar to that used to form resonators 306, 316 of FIG. 3. The resonator material may be rapidly quenched and annealed prior to assembly of the marker 500.

The resonators are shown in FIG. 5 as having generally rectangular shapes with planar cross-sectional profiles. The present solution is not limited in this regard. The resonators can have any shape selected in accordance with a given application. For example, the resonators 506, 508 alternatively have arched or concave cross-sectional profiles. Also, the resonators 506, 508 can have the same geometric dimensions or different geometric dimensions (e.g., width, length and/or thickness). Resonators with different geometric dimensions allow for additional signal complexity.

The bias element(s) 516, 528, 530 is(are) formed of any suitable resonator material. An illustrative suitable resonator material is a semi-hard magnetic material, such as the material designated as "SensorVac", which is available from Vacuumschmelze, Hanau, Germany. The bias element 516, 528, 530 is in a ribbon-shaped length of the semi-hard magnetic material. The bias element 516, 528, 530 has a width of equal to or less than 6 mm and a thickness of equal to or less than 48 microns.

In order to place the bias element(s) 516, 528, 530 in an activated condition, the bias element(s) is(are) magnetized substantially to saturation with the polarity of magnetization parallel to the length of the bias element(s). To deactivate the marker, the magnetic state of the bias element(s) is(are) substantially changed by degaussing the bias element(s) via the application of an AC magnetic field. When the bias element(s) is(are) degaussed, it(they) no longer provides the bias field required to cause the resonators 506, 508 to oscillate at the operating frequency of the EAS system.

The resonators 506, 508 are disposed along an axis 532 so as to reside on opposing sides of the marker 500 and have a generally parallel arrangement. The horizontal distance between the resonators is selected so that destructive coupling between the two resonators is minimized (i.e., increase amplitude efficiency) while retaining as small of a footprint as possible. The resonators 506, 508 are also disposed adjacent to or in proximity with the bias element 516. In effect, the resonators 506, 508 are equally spaced apart from and/or biased by the same bias element 516. The spacing between each resonator and the bias element is selected to prevent magnetic clamping. The distance between the resonators is determined by the bias element's thickness (e.g., 2 mils) and the first housing portion's thickness (e.g., 4-6 mils). Bias elements 528, 530 may also be disposed on opposing sides of the housing 502. In this case, the resonators 506, 508 are also respectively biased by additional bias elements 528, 530. The horizontal distance between each resonator and a bias element is selected based on bias flux and/or the marker's required bias operating field $H_{operating}$. In some scenarios, the horizontal distance is less than or equal to 100 mils.

The bias element(s) is(are) placed in insert space(s) 534, 536, 538 formed in the first housing portion 504. The insert space(s) is(are) designed so that a bottom surface 534 of the bias element is vertically offset from a top surface 536 of the resonators 506, 508. The amount of vertical offset is selected in accordance with a particular application. For example, the vertical offset is selected so that the bottom surface 534 is aligned with axis 532. The present solution is not limited in this regard. In other scenarios, the bias element(s) is(are) planar with the resonators such that there is no vertical offset.

As noted above, the resonators 506, 508 are placed in separate cavities formed in the housing 502. In this regard, the housing 502 comprises a first housing portion 504 with two cavities 520, 522 formed therein. The horizontal distance between the two cavities is selected based on the number of bias elements utilized, the bias element width(s), and/or the bias element flux level(s). The resonators 506, 508 are respectively disposed in the two separate cavities 520, 522. As a result, the coupling between the resonators 506, 508 is reduced as compared to that of the conventional markers 200 having two resonators 206, 208. Additionally, the frequencies of the resonators 506, 508 are not pulled together as much as is the case when both resonators are in the same cavity (as shown in FIG. 2). Also, the two resonators 506, 508 do not load each other as much as when both are in the same cavity (as shown in FIG. 2), so the amplitude from the two resonators 506, 508 is approximately two times the output from a marker comprising only one resonator.

Since the resonators 506, 508 are more loosely coupled, a signal having a beat frequency is generated by the marker 500 in response to a transmit burst transmitted from a transmitter (e.g., transmitter 112, 108 of FIG. 1). The advantages of this beat frequency are discussed above in relation to FIG. 3.

The housing 502 can include, but is not limited to, a high impact polystyrene. An adhesive 512 and release liner 514 are disposed on the bottom surface of a second housing portion 510 so that the marker 500 can be attached to an article (e.g., a piece of merchandise).

Figure 6:
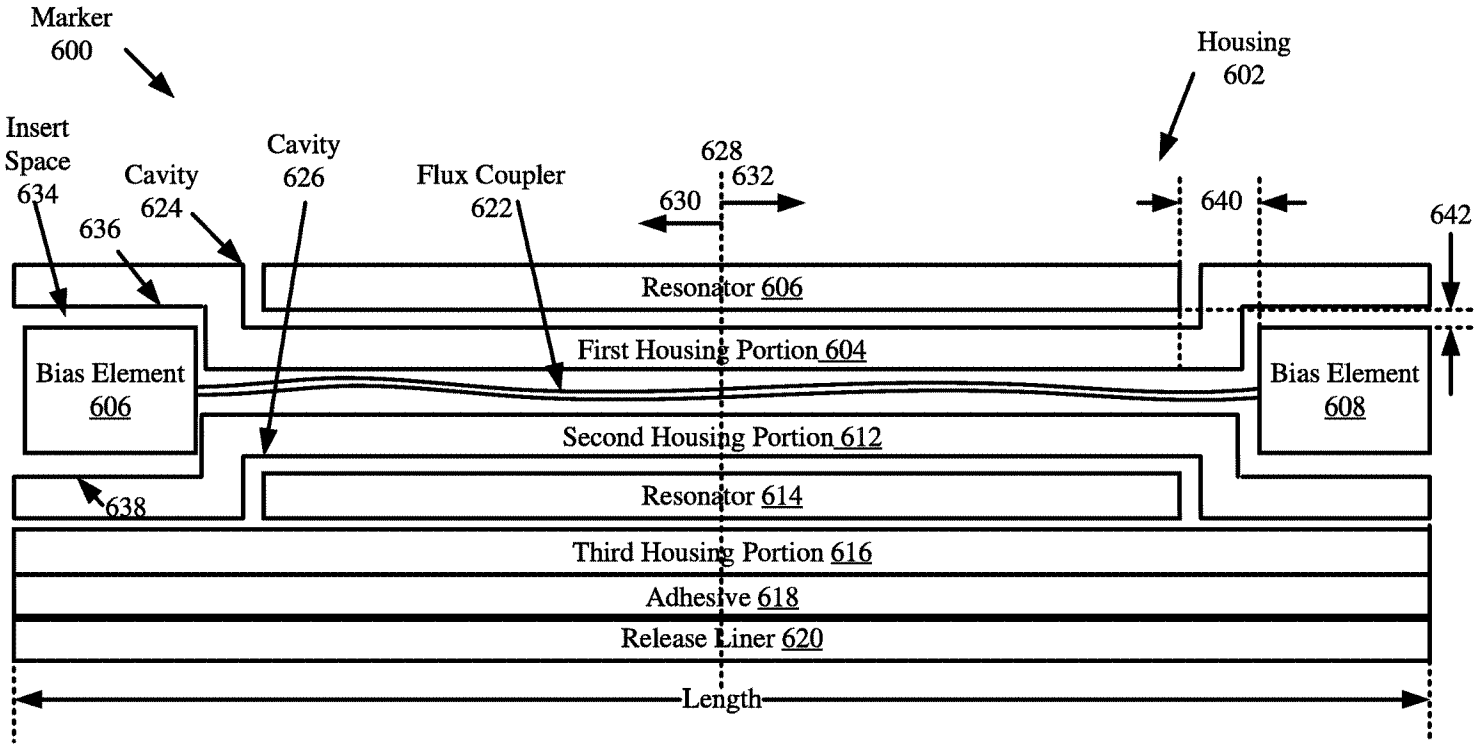
FIG. 6 is an illustration of another illustrative marker designed in accordance with the present solution.

Referring now to FIG. 6, there is provided an illustration of an illustrative marker 600 designed in accordance with the present solution. Marker 600 has an increased amplitude as compared to that of conventional marker 200 shown in FIG. 2. The increased amplitude of marker 600 at least partially results from (a) the materials used to form the resonators 606, 614 and bias element(s) 606, 608 and/or (b) the placement of the two resonators 606, 614 in separate cavities 624, 626 formed in the housing 602.

The resonators 606, 614 can be formed of any suitable resonator material. This material can be the same as or similar to that used to form resonators 306, 316 of FIG. 3. The resonator material may be rapidly quenched and annealed prior to assembly of the marker 600.

The resonators are shown in FIG. 6 as having generally rectangular shapes with planar cross-sectional profiles. The present solution is not limited in this regard. The resonators can have any shape selected in accordance with a given application. For example, the resonators 606, 614 alternatively have arched or concave cross-sectional profiles. Also, the resonators 606, 614 can have the same geometric dimensions or different geometric dimensions (e.g., width, length and/or thickness). Resonators with different geometric dimensions allow for additional signal complexity.

The bias element 606, 608 can be formed of any suitable resonator material. An illustrative suitable resonator material is a semi-hard magnetic material, such as the material designated as "SensorVac", which is available from Vacuumschmelze, Hanau, Germany. The bias elements 606, 608 are coupled to each other via a flux coupler 622. Flux couplers are well known in the art, and therefore will not be described herein. Any known or to be known flux coupler can be used herein without limitation. The flux coupler 622 is disposed between a first housing portion 604 and a second housing portion 612.

In order to place the bias element(s) 606, 608 in an activated condition, the bias element(s) is(are) magnetized substantially to saturation with the polarity of magnetization parallel to the length of the bias element(s). To deactivate the marker, the magnetic state of the bias element(s) is(are) substantially changed by degaussing the bias element(s) via the application of an AC magnetic field. When the bias element(s) is(are) degaussed, it(they) no longer provides the bias field required to cause the resonators 306, 316 to oscillate at the operating frequency of the EAS system. In FIG. 6, reversing the magnetization of one of the two bias elements can also deactivate the marker.

The resonators 606, 614 are disposed along an axis 628 so as to reside on opposing sides of the flux coupler 622 and have a generally parallel arrangement. The bias elements 606, 608 are disposed at each end of the resonators. The bias elements 606, 608 are disposed in insert spaces so as to be respectively offset from axis 628 in two opposing directions 630, 632. The flux coupler 622 resides between the first and second housing portions 604, 612 and extends along the length of cavities 624, 626. In effect, the resonators 606, 614 are equally spaced apart from and/or biased by the same bias elements 606, 608 and flux coupler 622.

The insert spaces 634 are at least partially defined by a surface 636 of the first housing portion 604 and at least partially defined by a surface 638 of the second housing portion 612. The insert spaces 634 are designed so that the bias elements 606, 608 are horizontally offset from the resonators 606, 614 by a given amount 640 and/or vertically offset from the resonators by a given amount 642. The present solution is not limited in this regard. For example, each bias element can alternatively be arranged so that at least a vertical portion thereof overlaps or is aligned with a vertical portion of each resonator. The amount of vertical overlap is selected in accordance with a particular application. In other scenarios, the distance 642 is equal to zero, or the bias elements could be level with the top of the resonator 606 and bottom of resonator 614.

As noted above, the resonators 606, 614 are placed in separate cavities 624, 626 formed in the housing 502. In this regard, the housing 602 comprises a first housing portion 604 with a first cavity 624 formed therein and a second housing portion 612 with a second cavity 626 formed therein. The resonators 606, 614 are respectively disposed in the two separate cavities 624, 626. As a result, the coupling between the resonators 624, 626 is reduced as compared to that of the conventional markers 200 having two resonators 206, 208. Additionally, the frequencies of the resonators 624, 626 are not pulled together as much as is the case when both resonators are in the same cavity (as shown in FIG. 2). Also, the two resonators 624, 626 do not load each other as much as when both are in the same cavity (as shown in FIG. 2), so the amplitude from the two resonators 624, 626 is approximately two times the output from a marker comprising only one resonator.

Since the resonators 624, 626 are more loosely coupled, a signal having a beat frequency is generated by the marker 600 in response to a transmit burst transmitted from a transmitter (e.g., transmitter 112, 108 of FIG. 1). The advantages of this beat frequency are discussed above in relation to FIG. 3.

The housing 602 can include, but is not limited to, a high impact polystyrene. An adhesive 618 and release liner 620 are disposed on the bottom surface of a third housing portion 616 so that the marker 500 can be attached to an article (e.g., a piece of merchandise).

Figure 7:
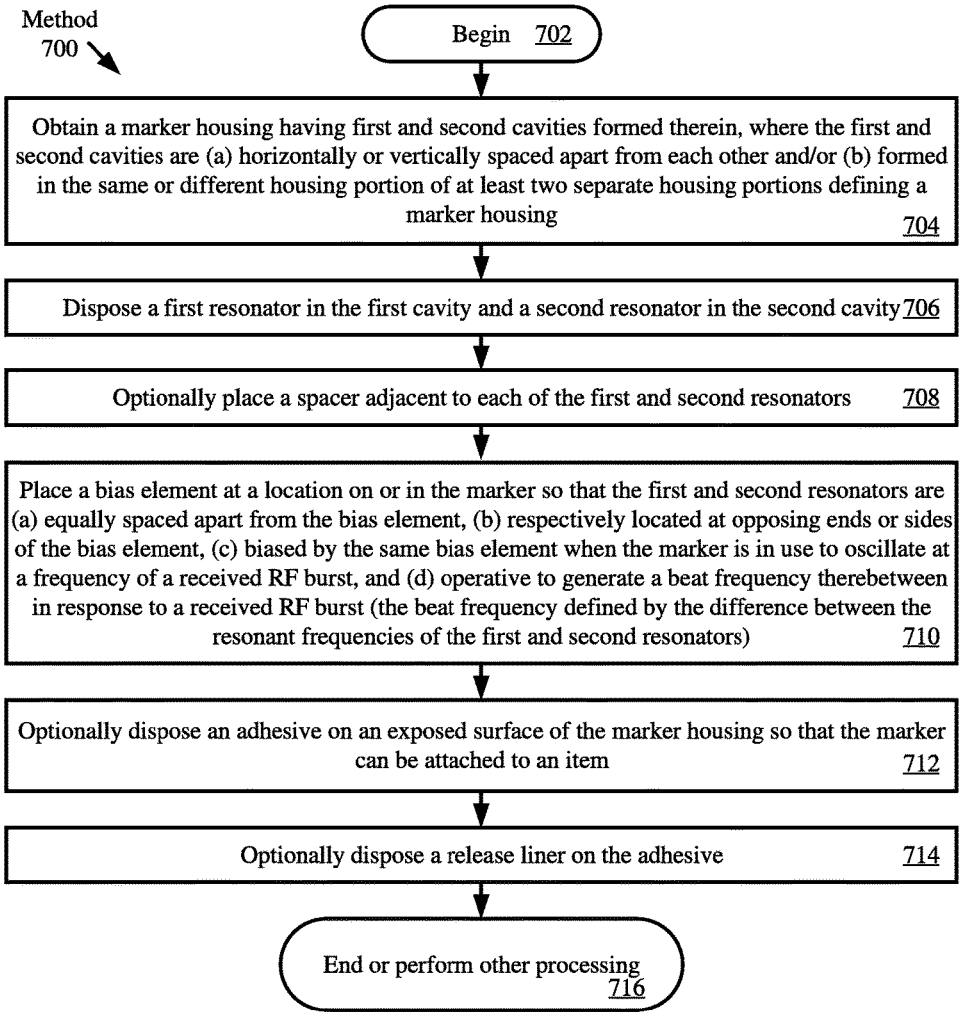
FIG. 7 is a flow diagram of an illustrative method for making a marker.

Referring now to FIG. 7, there is provided a flow diagram of an illustrative method 700 for making a marker. Method 700 begins with step 702 and continues with step 704. Step 704 involves obtaining a marker housing having first and second cavities (e.g., cavities 324, 328 of FIG. 3, cavities 420, 422 of FIG. 4, cavities 520, 522 of FIG. 5, or cavities 624, 626 of FIG. 6) formed therein. The first and second cavities are (a) horizontally or vertically spaced apart from each other, (b) formed in the same or different housing portion of at least two separate housing portions (e.g., housing portions 304 and 318 of FIGS. 3, 404 and 414 of FIGS. 4, 504 and 510 of FIG. 5, or 604 and 616 of FIG. 6) defining a marker housing (e.g., housing 302 of FIG. 3, 402 of FIG. 4, 502 of FIG. 5, or 602 of FIG. 6).

In 706, a first resonator (e.g., resonator 306 of FIG. 3, 406 of FIG. 4, 506 of FIG. 5, or 606 of FIG. 6) is disposed in the first cavity. A second resonator (e.g., resonator 316 of FIG. 3, 408 of FIG. 4, 508 of FIG. 5, or 614 of FIG. 6) is disposed in the second cavity. A spacer (e.g., spacer 310 of FIG. 3, 314 of FIG. 3, and/or 410 of FIG. 4) is optionally placed adjacent to the first and second resonators, as shown by 708.

In 710, a bias element is placed at a location on or in the marker (e.g., marker 300 of FIG. 3, 400 of FIG. 4, 500 of FIG. 5 or 600 of FIG. 6) so that the first and second resonators are (a) equally spaced apart from the bias element, (b) respectively located at opposing ends or sides of the bias element, (c) biased by the same bias element when the marker is in use to oscillate at a frequency of a received transmit burst, and/or (d) operative to generate a beat frequency therebetween in response to a received transmit burst. The beat frequency is defined by the difference between the resonant frequencies of the first and second resonators.

In 712, an adhesive may optionally be disposed on an exposed surface of the marker housing. In 714, a release liner may be optionally disposed on the adhesive. The adhesive and release liner provide a means for allowing the marker to be selectively coupled to an item (e.g., a piece of merchandise or product packaging). Subsequently, 716 is performed where method 700 ends or other processing is performed.

All of the apparatus, methods, and algorithms disclosed and claimed herein can be made and executed without undue experimentation in light of the present disclosure. While the present solution has been described in terms of preferred embodiments, it will be apparent to those having ordinary skill in the art that variations may be applied to the apparatus, methods and sequence of steps of the method without departing from the concept, spirit and scope of the present solution. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the present solution as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A method of making a marker, comprising:

obtaining a marker housing having first and second cavities formed therein;

disposing a first resonator in the first cavity and a second resonator in a second cavity; and placing a bias element at a location on or in the marker so that the first and second resonators are (a) equally spaced apart from the same bias element and (b) biased by the same bias element when the marker is in use to oscillate at a frequency of a received transmit burst;

wherein the first resonator and second resonator have different geometric dimensions;

wherein the first and second cavities have different shapes and/or sizes selected in accordance with the first and second resonators' geometries.

2. A method of making a marker, comprising:

obtaining a marker housing having first and second cavities formed therein;

disposing a first resonator in the first cavity and a second resonator in a second cavity; and placing a bias element at a location on or in the marker so that the first and second resonators are (a) equally spaced apart from the same bias element and (b) biased by the same bias element when the marker is in use to oscillate at a frequency of a received transmit burst;

wherein the first and second cavities are horizontally spaced apart.

3. The method according to claim 1, wherein the first and second cavities are vertically spaced apart.

4. A method of making a marker, comprising:

obtaining a marker housing having first and second cavities formed therein;

disposing a first resonator in the first cavity and a second resonator in a second cavity; and placing a bias element at a location on or in the marker so that the first and second resonators are (a) equally spaced apart from the same bias element and (b) biased by the same bias element when the marker is in use to oscillate at a frequency of a received transmit burst;

wherein the first and second cavities are formed in the same housing portion of at least two separate housing portions defining the marker housing.

5. The method according to claim 1, wherein the first and second cavities are formed in different housing portions of at least two separate housing portions defining the marker housing.

6. A method of making a marker, comprising:

obtaining a marker housing having first and second cavities formed therein;

disposing a first resonator in the first cavity and a second resonator in a second cavity; and placing a bias element at a location on or in the marker so that the first and second resonators are (a) equally spaced apart from the same bias element and (b) biased by the same bias element when the marker is in use to oscillate at a frequency of a received transmit burst;

wherein the first and second cavities have different shapes and/or sizes selected in accordance with the first and second resonators' geometries.

7. The method according to claim 1, wherein the first and second resonators respectively reside on two opposing sides or ends of the bias element.

8. The method according to claim 1, wherein a detectable beat frequency is generated between the resonators in response to the received transmit burst.

9. The method according to claim 1, wherein the bias element is sandwiched between the first and second resonators.

10. A marker, comprising:

a marker housing having first and second cavities formed therein;

a first resonator disposed in the first cavity and a second resonator in a second cavity; and a bias element placed at a location on or in the marker housing so that the first and second resonators are (a) equally spaced apart from the same bias element and (b) biased by the same bias element when the marker is in use to oscillate at a frequency of a received transmit burst;

wherein the first resonator and second resonator have different geometric dimensions;

wherein the first and second cavities have different shapes and/or sizes selected in accordance with the first and second resonators' geometries.

11. A marker, comprising:

a marker housing having first and second cavities formed therein;

a first resonator disposed in the first cavity and a second resonator in a second cavity; and a bias element placed at a location on or in the marker housing so that the first and second resonators are (a) equally spaced apart from the same bias element and (b) biased by the same bias element when the marker is in use to oscillate at a frequency of a received transmit burst;

wherein the first and second cavities are horizontally spaced apart.

12. The marker according to claim 10, wherein the first and second cavities are vertically spaced apart.

13. A marker, comprising:

a marker housing having first and second cavities formed therein;

a first resonator disposed in the first cavity and a second resonator in a second cavity; and a bias element placed at a location on or in the marker housing so that the first and second resonators are (a) equally spaced apart from the same bias element and (b) biased by the same bias element when the marker is in use to oscillate at a frequency of a received transmit burst;

wherein the first and second cavities are formed in the same housing portion of at least two separate housing portions defining the marker housing.

14. The marker according to claim 10, wherein the first and second cavities are formed in different housing portions of at least two separate housing portions defining the marker housing.

15. A marker, comprising:

a marker housing having first and second cavities formed therein;

a first resonator disposed in the first cavity and a second resonator in a second cavity; and a bias element placed at a location on or in the marker housing so that the first and second resonators are (a) equally spaced apart from the same bias element and (b) biased by the same bias element when the marker is in use to oscillate at a frequency of a received transmit burst;

wherein the first and second cavities have different shapes and/or sizes selected in accordance with the first and second resonators' geometries.

16. The marker according to claim 10, wherein the first and second resonators respectively reside on two opposing sides or ends of the bias element.

17. The marker according to claim 10, wherein a detectable beat frequency is generated between the resonators in response to the received transmit burst.

18. The marker according to claim 10, wherein the bias element is sandwiched between the first and second resonators.

* * * * *